US010431401B2

(12) United States Patent
Benda et al.

(10) Patent No.: US 10,431,401 B2
(45) Date of Patent: Oct. 1, 2019

(54) LOCK OUT/TAG OUT DEVICE HAVING A TIE-RECEIVING PASSAGEWAY

(71) Applicant: Brady Worldwide, Inc., Milwaukee, WI (US)

(72) Inventors: Steven J. Benda, Cokato, MN (US); Nels E. Benda, Hancock, MI (US); Chad M. Benda, Cokato, MN (US)

(73) Assignee: Brady Worldwide, Inc., Milwaukee, WI (US)

( * ) Notice: Subject to any disclaimer, the term of this patent is extended or adjusted under 35 U.S.C. 154(b) by 634 days.

(21) Appl. No.: 15/098,556

(22) Filed: Apr. 14, 2016

(65) Prior Publication Data

US 2016/0336122 A1 Nov. 17, 2016

Related U.S. Application Data

(60) Provisional application No. 62/159,914, filed on May 11, 2015, provisional application No. 62/230,568, filed on Jun. 8, 2015, provisional application No. 62/284,669, filed on Oct. 5, 2015.

(51) Int. Cl.
*H01H 9/28* (2006.01)

(52) U.S. Cl.
CPC ..... *H01H 9/283* (2013.01)

(58) Field of Classification Search
CPC ..... Y10T 292/48; Y10T 292/496; Y10T 292/498; Y10T 292/507; Y10T 292/494; Y10T 292/499; Y10T 292/505; Y10T 292/509; Y10T 292/516; Y10T 24/42; Y10T 24/44026; Y10T 24/45524; Y10T 24/50; Y10T 24/505; Y10T 292/1025; Y10T 292/495; G09F 3/037; G09F 3/0292; G09F 3/0347; B65D 55/02
See application file for complete search history.

(56) References Cited

U.S. PATENT DOCUMENTS 2,557,565 A * 6/1951 Rifkin ..... A45C 1/10 292/264
3,955,842 A * 5/1976 Edwards ..... A44B 19/301 292/307 R
5,122,624 A 6/1992 Benda
5,300,740 A 4/1994 Benda
5,447,344 A * 9/1995 Hayward ..... G09F 3/0394 292/246
5,500,495 A 3/1996 Benda et al.
(Continued)

*Primary Examiner* — Mark A Williams
(74) *Attorney, Agent, or Firm* — Quarles & Brady LLP

(57) ABSTRACT

A device and related method temporarily restrict use of a control via one or more of lock out and tag out. The device includes a first and second portion. The first portion has a passageway adapted for the reception of a tie that extends through the first portion along a distance of passageway extension. The second portion has a tang and is movable relative to the first portion to move the tang transversely across the passageway relative to the direction of passageway extension to toggle the device between an opened position and a closed position. A tie may be received in the passageway and the reception of this tie in the passageway may prevent the device from being moved from the closed position back into the opened position due to inability of the tang of the second portion to be moved past the tie in the passageway of the first portion.

10 Claims, 10 Drawing Sheets

(56) References Cited

U.S. PATENT DOCUMENTS

| | | | | | |
|---|---|---|---|---|---|
| 5,568,951 | A * | 10/1996 | Morgan | B65D 55/02 | 283/98 |
| 5,931,032 | A * | 8/1999 | Gregory | B82Y 10/00 | 292/148 |
| 6,727,441 | B2 * | 4/2004 | Benda | H01H 9/283 | 200/43.11 |
| 7,360,744 | B2 * | 4/2008 | Kwilosz | F16L 3/137 | 248/68.1 |
| 8,052,180 | B1 * | 11/2011 | Lassen | B65D 90/22 | 292/307 A |
| 2004/0245077 | A1 | 12/2004 | Benda | | |
| 2008/0315596 | A1 * | 12/2008 | Terry | E05B 39/02 | 292/327 |
| 2012/0091177 | A1 * | 4/2012 | Ackeret | B60R 7/043 | 224/275 |
| 2015/0108772 | A1 * | 4/2015 | Boesel | E05B 67/383 | 292/307 R |

* cited by examiner

LOCK OUT/TAG OUT DEVICE HAVING A TIE-RECEIVING PASSAGEWAY

CROSS-REFERENCE TO RELATED APPLICATION

This application claims the benefit of the filing date of U.S. Provisional Patent Application Nos. 62/159,914 filed May 11, 2015, entitled "Hazardous Energy Source Tags and Lockouts", 62/230,568 filed Jun. 8, 2015, entitled "Tag-Lock for Hazardous Energy Source", and 62/284,669 filed Oct. 5, 2015, entitled "Hazardous Energy Source Tags and Lockouts" which are hereby incorporated by reference for all purposes as if set forth in their entirety herein.

TECHNICAL FIELD

This disclosure relates to lock out/tag out devices for restricting the use of hazardous energy isolation controls, such as switches.

BACKGROUND

Machines or equipment often contain energy sources that can be potentially hazardous to workers if these energy sources are not properly controlled and maintained during servicing of the equipment. These energy sources may be, as some non-limiting examples, electrical, mechanical, hydraulic, pneumatic, chemical, or thermal in nature.

In order to protect workers from these energy sources while servicing or maintaining the machines or equipment, proper lock out/tag out procedures and practices may be voluntarily adopted or may be required by the Occupational Safety and Health Administration (OSHA). What constitutes appropriate lock out/tag out practices and procedures will largely depend on the specific equipment. Lock out/tag out procedures and practices involve following pre-determined steps or operations in order to disable the machinery or equipment to prevent the release of potentially hazardous energy before the equipment is maintained or to ensure that, when the equipment is placed back into service, workers remain protected from the potentially hazardous energy.

Some non-limiting examples of lock out/tag out devices can be found in U.S. Pat. Nos. 5,122,624; 5,300,740; 5,500,495; and 6,727,441 and U.S. Patent Application Publication No. 2004/0245077 which are incorporated by reference. U.S. Pat. No. 6,727,441 describes a switch lever lock out assembly engagable with a switch to prevent operation of the switch having a key-engagable mechanism to unlock the lock out assembly. U.S. Patent Application Publication No. 2004/0245077 describes another switch lock out assembly for locking out a switch having a pivotally-mounted movable tongue.

SUMMARY

An improvement to lock out/tag out devices is disclosed herein which permits a tie (such as, for example, a zip tie) to be received in a passageway that blocks the lock out/tag out device from being opened when the device is in the closed position. It is contemplated that this may offer an additional method of securing the device with other existing securing mechanisms. In some forms, this tie-receiving passageway may offer an improved option for one-handed installation of the device at the lockout point because the tie may be preloaded in the passageway with, in some cases, a workman's protective tag and the device may be toggled one-way from the opened position to the closed position with the tie already in place. This action might be done with a single hand, using for example a pinching action, and obviate the need for a padlock to be installed into the device at the lockout point, which generally requires the use of two hands for installation. It is also contemplated that the tie may be loaded into the tie-receiving passageway after the device is in the closed position. In either case, the tie prevents the device, secured in the closed position, from being moved back into the opened position thereby locking the device in place. Upon removal of the tie, by severing the tie or otherwise removing it, the device again becomes capable of being moved to an opened position or configuration (as long as any padlock has also been removed).

Accordingly, the disclosed device provides a way that a user can accomplish both the greater physical security provided by lock out and the visual identification provided by tag out (for example, an attached ID tag) without having to apply a padlock which generally requires two hands to install. However, a padlock may certainly still be used to secure the device independently or in combination with the tie.

According to one aspect, a device for temporarily restricting use of a control (such as, for example, a hazardous energy isolation control) via one or more of lock out and tag out is disclosed. The device includes first and second portions which are movable relative to one another. The first portion of the device has a passageway extending through it along a distance of passageway extension and this passageway is adapted for reception of a tie (for example, a zip tie). The second portion of the device has a tang. The second portion is movable relative to the first portion to move the tang transversely across the passageway relative to the direction of passageway extension when toggling the device between an opened position and a closed position.

A tie may be received in the passageway. The reception of a tie in the passageway can prevent the device from being moved from the closed position back into the opened position due to the inability of the tang of the second portion to be moved past the tie in the passageway of the first portion when the tie is in place.

According to some forms, the tang may include an arm extending to a distal end having a projection. The arm may be elastically flexible relative to a remainder of the second portion to accommodate a temporary deflection of the projection of the tang. The arm, tang, or any combination thereof may be constructed of, for example, thermoplastic or metals. The projection itself may have one or more of an inclined tapered surface and a locking surface. The inclined tapered surface can be angled with respect to a direction of movement of the second portion relative to the first portion. The locking surface may be perpendicular to the direction of movement of the second portion relative to the first portion. However, these are exemplary configurations and a projection might have various profiles capable of performing the functions of these surfaces described in greater detail below.

In some forms, the first portion may be a housing with an internal cavity and the second portion may be a body received at least in part within the housing such that the body is linearly translatable within the housing to toggle the device between an opened position and a closed position. In this form, the device may further include a clip received between the housing and the body in which the clip is U-shaped having a pair of opposing terminal ends that generally face one another. The clip may have a pre-defined unstressed shape and may be elastically deformable under stress to alter a spacing distance between the pair of terminal ends. When the device is in the opened position, the ends can have an opened spacing distance and, when the device is in the closed position, the ends can have a closed spacing distance (such that the opened spacing distance is greater than the closed spacing distance). The clip may be transposed between the housing and the body such that the placement of the housing and the body relative to one another alter the spacing of the ends of the clip relative to one another and the clip may further be used in conjunction with the housing and body to provide a biasing force (for example, to cause the device to tend toward the opened position).

In some forms, the body may include a tab with at least one opening formed in the tab and the housing may have a slot through which the tab extends. In the closed position, the opening(s) may be outside the housing and the presence of an item (such as, for example a padlock or tie) through one or more of the opening(s) in the closed position may prevent the body from being translated relative to the housing (as the item in the at least one opening would interfere with the housing), such that the device cannot be moved from the closed position to the opened position when the item is in the opening(s). The orientation of the tab may provide easy access to the opening for selective attachment of the locking item. For example, the tab itself may be perpendicular in orientation to a hazardous energy isolation control which the device is being attached such that insertion of the locking item into the opening is relatively not limited spatially by a hazardous energy isolation control or surrounding control housing. Put another way, in certain circumstances, the opening(s) in the tab may extend in a direction parallel with the direction of passageway extension.

In other forms, the first portion and the second portion may be pivotable relative to one another about an axis of rotation. When the device is toggled between the opened position and the closed position, the tang of the second portion may then rotate transversely across the passageway of the first portion.

In some forms, the passageway may be an open channel with at least one unbounded side over the distance of passageway extension or some portion thereof. In other forms, the passageway may be a closed channel over at least a portion thereof having openings one or more of ends of the distance of passageway extension.

According to another aspect, a method of restricting a control (such as, for example, a hazardous energy isolation control) via one or more of lock out and tag out using a device of the type described herein is disclosed. The second portion is moved relative to the first portion to toggle the device from the opened position to the closed position, thereby moving the tang of the second portion transversely across a passageway extending through the first portion. A tie is inserted in the passageway extending through the first portion along a distance of passageway extension of the first portion. Accordingly, when the device is in the closed position and with a tie received in the passageway, the reception of the tie in the passageway prevents the device from being moved from the closed position back into the opened position due to the inability of the tang of the second portion to be moved past the tie in the passageway of the first portion.

It is contemplated that the order of the steps of this method may be varied and the same result achieved.

For example, the step of moving the second portion relative to the first portion to toggle the device from the opened position to the closed position may occur before the step of inserting the tie in a passageway. In this instance, at the insertion of the tie, the device is already in a closed position and the tie prevents it from being moved to the open position (without first removing the tie).

However, it is also contemplated that the step of inserting the tie in a passageway may occur before the step of moving the second portion relative to the first portion to toggle the device from the opened position to the closed position. In that instance, moving the second portion relative to the first portion to toggle the device from the opened position to the closed position may include temporarily deflecting the tang to permit the tang to pass the tie in the passageway.

To accommodate the temporary deflecting of the tang, in some forms and as noted above, the tang may comprise an arm extending to a distal end having a projection in which the arm is elastically flexible relative to a remainder of the second portion. The projection of the tang may have an inclined tapered surface that interacts with the tie to effectuate the temporary deflecting of the tang during the step of moving the second portion relative to the first portion to toggle the device from the opened position to the closed position.

In some forms, the tang may have a projection including a locking surface. When the device is in a closed position and the passageway has a tie received therein, this locking surface can engage the tie to inhibit the device from being toggled to the opened position.

It is contemplated that a projection might include the inclined tapered surface, a locking surface separately, or both in combination with one another.

In some forms, the step of moving the second portion relative to the first portion to toggle the device from the opened position to the closed position may involve the linear translation of the second portion relative to the first portion. However in other forms, this step may involve a rotation of the second portion relative to the first portion.

According to still another aspect, a method is disclosed of locking out a control using a device having a first portion and a second portion in which the second portion is movable relative to the first portion. In this method, the second portion is moved relative to the first portion. A tie is inserted in a passageway extending through the first portion in which the tie prevents a tang from being moved from a first lateral side of the passageway to a second lateral side of the passageway across the tie. This presence of the tie in the passageway and positioning of the tang (in at least one position of the tang) locks further movement of the second portion relative to the first portion until the tie is removed and the tang is again movable from the first side of the passageway to the second side of the passageway.

In some forms, the tang may be on an element separately movable from the first portion and the second portion and have a portion that selectively engages the second element. For example, the element supporting the tang may be slidably received in a channel of the first portion and have a tip that is selectively engageable with the second portion to lock the movement (especially, the rotation) of the second portion relative to the first portion to prevent further movement of the second portion relative to the first portion. As with tangs that are integral with the first and second portions, it is contemplated that the tie might be pre-loaded or post-loaded into the passageway and that the tang may be movable past the passageway in one direction (but not the other) with the tie in the passageway in order to lock the movement of the first and second portions relative to one another until the tie is physically removed.

These and still other advantages of the invention will be apparent from the detailed description and drawings. What follows is merely a description of some preferred embodiments of the present invention. To assess the full scope of the invention, the claims should be looked to as these preferred embodiments are not intended to be the only embodiments within the scope of the claims.

DETAILED DESCRIPTION

Figure 1:
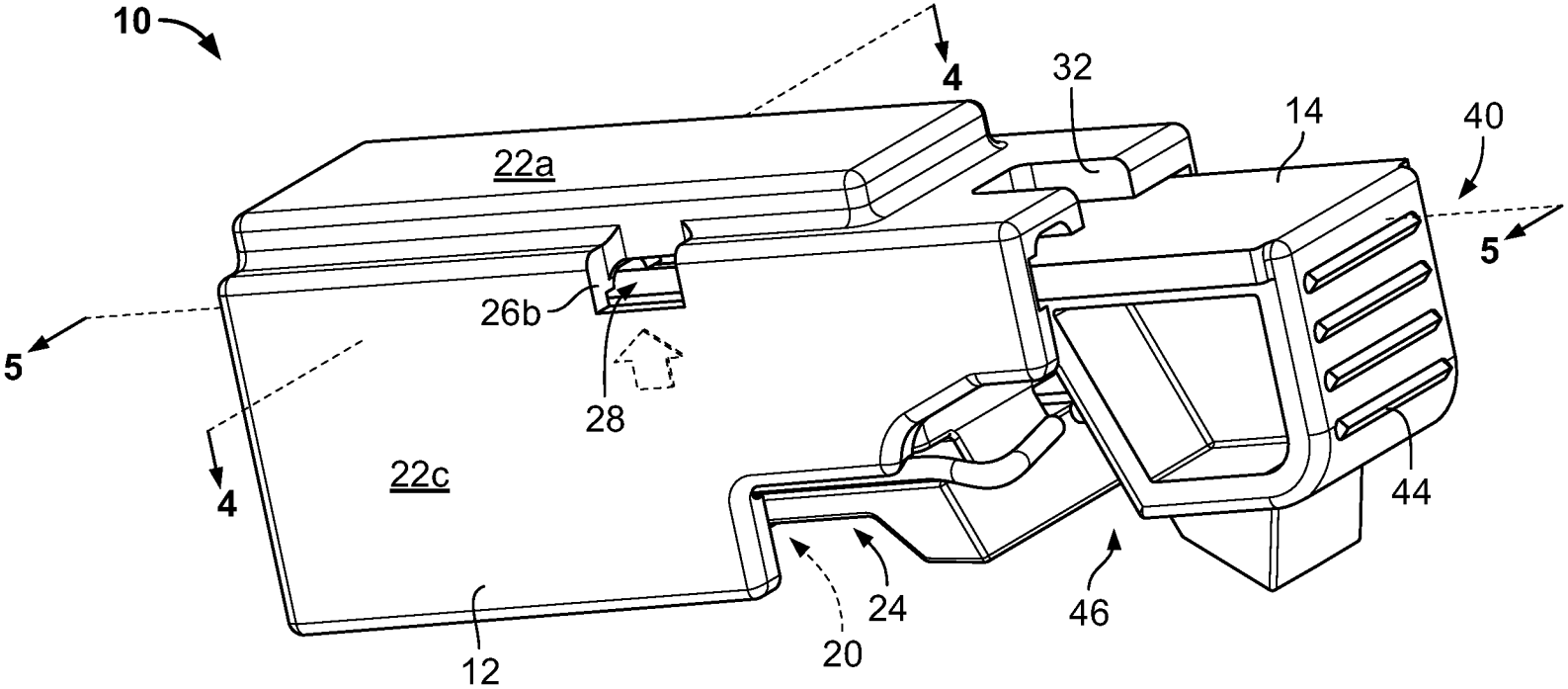
FIG. 1 is a perspective view of a lock out/tag out device in an opened position.
Figure 2:
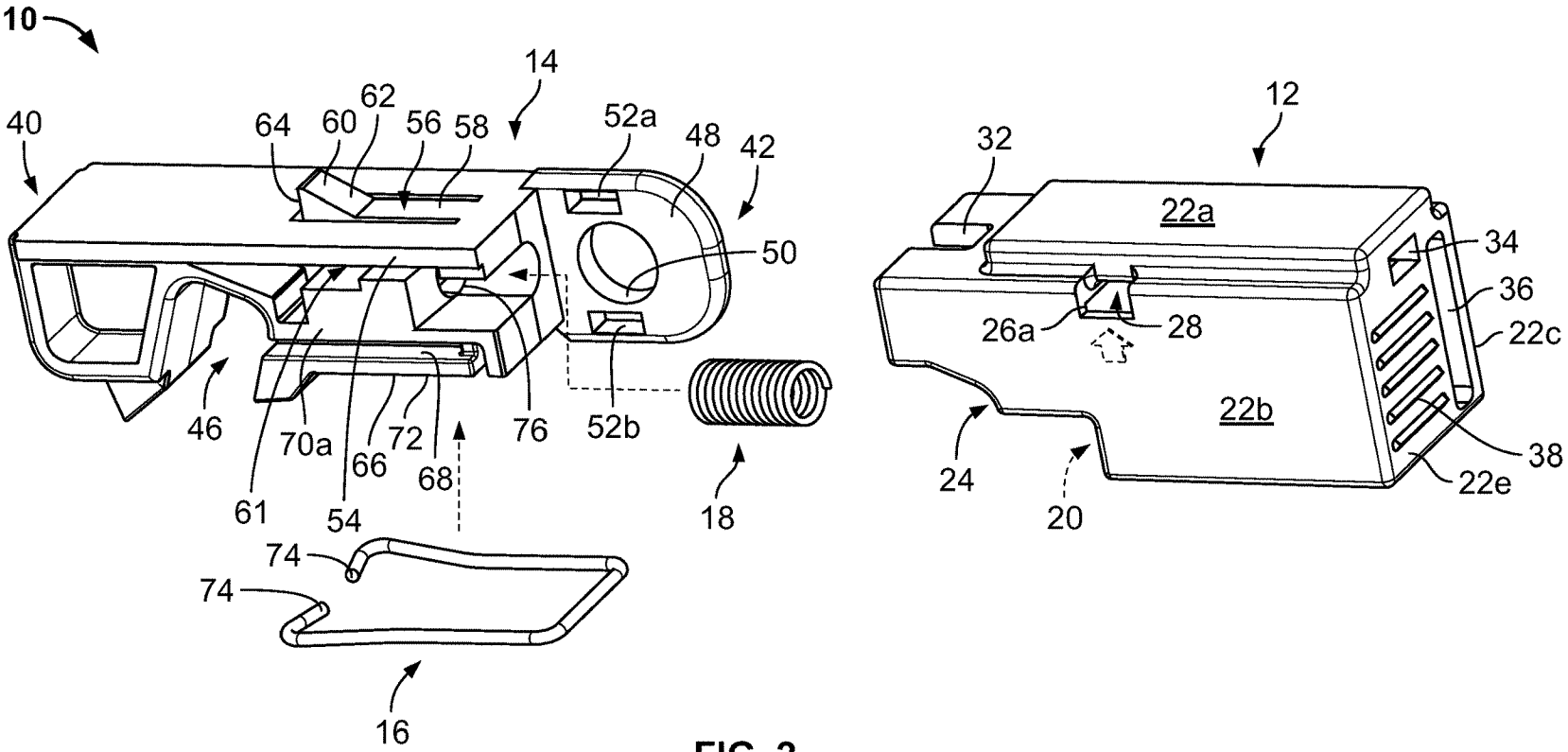
FIG. 2 is an exploded perspective view of the device illustrating the housing, the body normally received in the housing, the clip, and an optional spring.

Referring first to FIG. 1, an exemplary lock out/tag out device 10 is illustrated which can be used to temporarily lock out and/or tag out a control such as, for example, a circuit breaker switch. As illustrated, the lock out/tag out device 10 includes a housing 12, a body 14, a clip 16, and a coiled spring 18 (as best shown in FIG. 2). Each of these components will now be described in greater structural detail along with their specific connectivity to one another.

Now with additional reference to FIG. 2, the housing 12 is a generally rectangular shell having a central cavity 20 formed therein for reception of the body 14 of the device. The central cavity 20 is defined by a set of walls including a front wall 22*a*, a pair of top and bottom walls 22*b* and 22*c* (which are relative directions based on the direction of attachment), a rear wall 22*d* (shown in FIG. 6), and a left side wall 22*e* (left again being a relative direction). An opening 24 is provided on the side of the housing opposite the left side wall 22*e* that accommodates reception of the body 14 into the central cavity 20 of the housing 12. Various features are formed in the walls of the housing 12.

Most notably, each of the pair of top and bottom walls 22*b* and 22*c* have an opening 26*a* and 26*b* through which a passageway 28 extends. This passageway 28 is generally rectangular and is adapted to receive a tie (such as, for example, a zip tie) therethough in the direction of passageway extension. In some forms, the inside of the front wall 22*a*, that is, the side of the front wall 22*a* facing the inner cavity, may have a recess or channel formed therein that runs the partial or full length of the passageway 28. Accordingly, segments of the passageway may have one or more open sides or segments of the passageway may be completely surrounded.

Figure 4:
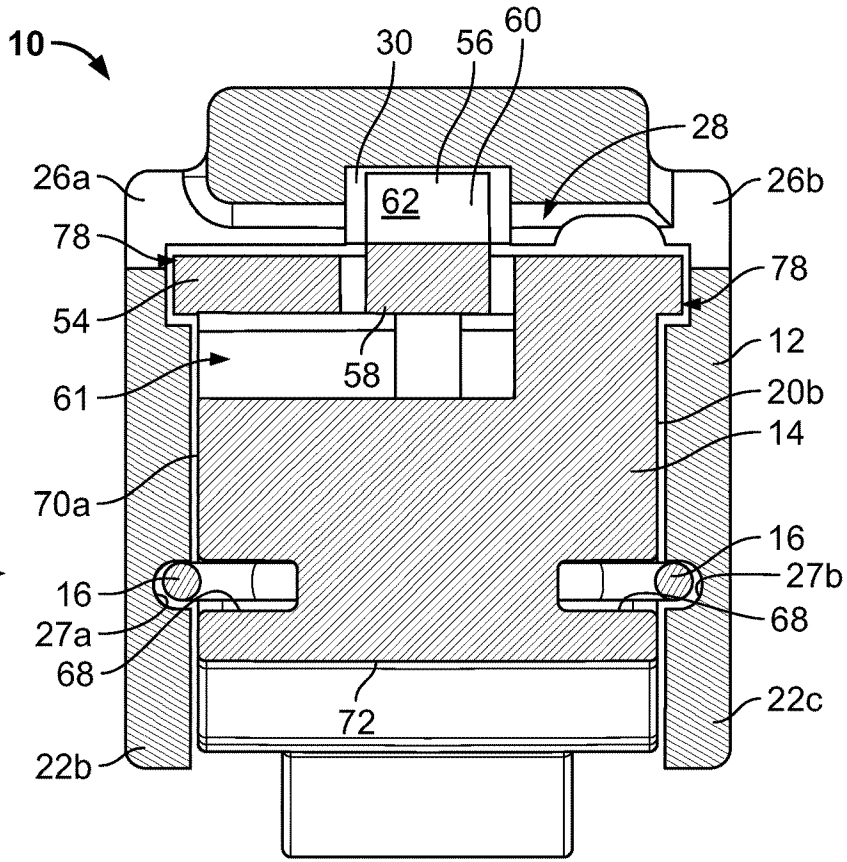
FIG. 4 is a right side cross-sectional view taken through line 4-4 of FIG. 1 illustrating the placement of the lock tab in the channel of the housing.
Figure 8:
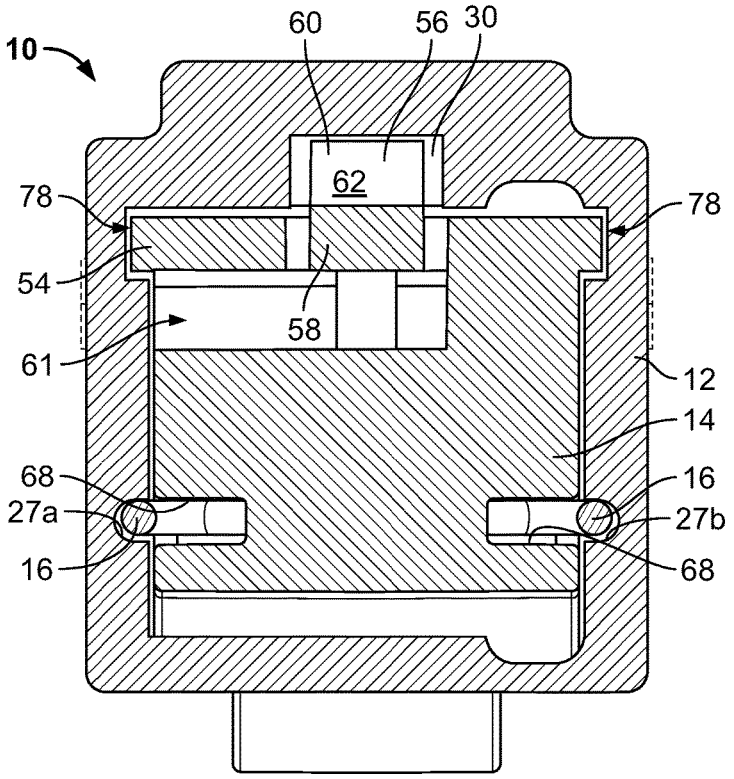
FIG. 8 is a right side cross-sectional view of the device in the closed position taken through line 8-8 of FIG. 6 illustrating the tab in a position that is cleared of the tie-receiving passageway, but in which position the presence of a tie in the tie-receiving passageway prevents the sideways movement of the body relative to the housing.

The pair of top and bottom walls 22*b* and 22*c* also include a set of clip tracks 27*a* and 27*b*, into which a portion of the clip 16 may be received. This feature is best illustrated in FIGS. 4 and 8.

In the particular embodiment illustrated, the inner side of the front wall 22*a* also includes a transversely-extending channel 30 to the passageway 28 and this channel can accommodate the projection of the tang 56 of the body 14. On one end of the transversely-extending channel 30 proximate the opening 24 to the central cavity 20, there is a U-shaped cutout 32 having a tapered section that can interact with the tang 56 during insertion of the body 14 into the housing 12 to cause the deflection of the tang 56 during insertion and snap to rest to prevent body 14 from being removed from housing 12. On the other end of the channel 30 terminating at the left side wall 22*e*, there is an opening 34 (to create an assembly catch for tang 56 to prevent housing 12 and body 14 from being separated after assembly).

In addition to the opening 34 on the left side wall 22*e* at the end of the channel 30, the left side wall 22*e* also includes an elongated slot 36 through which a tab 48 on the body 14 (described in greater detail below) may slide and selectively project. The direction of extension of this slot 36 is primarily from the front to rear side such that a flat tab extending therethrough would be generally parallel to the pair of top and bottom walls 22*b* and 22*c*. The left side wall 22*e* also includes a plurality of tactile projections 38 that provide a gripping, textured surface for contact by the user during operation of the lock out/tag out device 10.

Turning now to the body 14, the body 14 is generally rectangular in shape and extends from a right side 40 to a left side 42 (which directions are reversed in FIG. 2 relative to the orientation of FIG. 1 due to the change in perspective). Proximate the right side 40 of the body 14, there is another set of tactile projections 44 on the end surface which directly oppose the tactile projections 38 and a rearwardly-facing recess 46 formed in the body 14 that is shaped to receive a switch, for example, a circuit breaker. On the left side 42 of the body 14, there is a tab 48 including a central opening 50 and a pair of slots 52*a* and 52*b*. This tab 48 can be selectively extended from the slot 36 during operation depending on the relative placement of the body 14 relative to the housing 12 as the body 14 slides within the housing 12.

Notably, on the front surface of the body 14, there is a relatively thin wall 54 having a tang 56 formed therein. In the illustrated embodiment, the tang 56 is formed by a U-shaped absence of material the wall 54 around the tang 56. The tang 56 includes an arm 58 extending to a distal end having a projection 60. Based on the aforementioned construction and the fact that both the housing 12 and the body 14 may be constructed of a polymeric material, the arm 58 can be elastically flexible relative to a remainder of the body to accommodate a temporary deflection of the projection 60 of the tang 56 relative to the wall 54 of the body 14. To permit this deflection in a rearward direction, the body 14 can have a negative space 61 lacking material so that the tang 56 and projection 60 have sufficient space for clearance. This projection 60 can have an inclined tapered surface 62 with respect to a direction of movement of the body 14 relative to the housing 12 and a locking surface 64 that is perpendicular to the direction of movement of the body 14 relative to the housing 12.

Although one orientation of the tang 56 is illustrated in which the arm 58 extends in a rightward direction, the inclined tapered surface 62 faces the leftward direction, and the locking surface 64 faces the leftward direction, it should be appreciated that the direction of arm extension as well as the directionality and types of surfaces of the projection might be varied based on the manner in which the device is constructed to achieve similar functionality to that described below with respect to use as will be apparent to those having ordinary skill in the art from an understanding of this disclosure.

Figure 7:
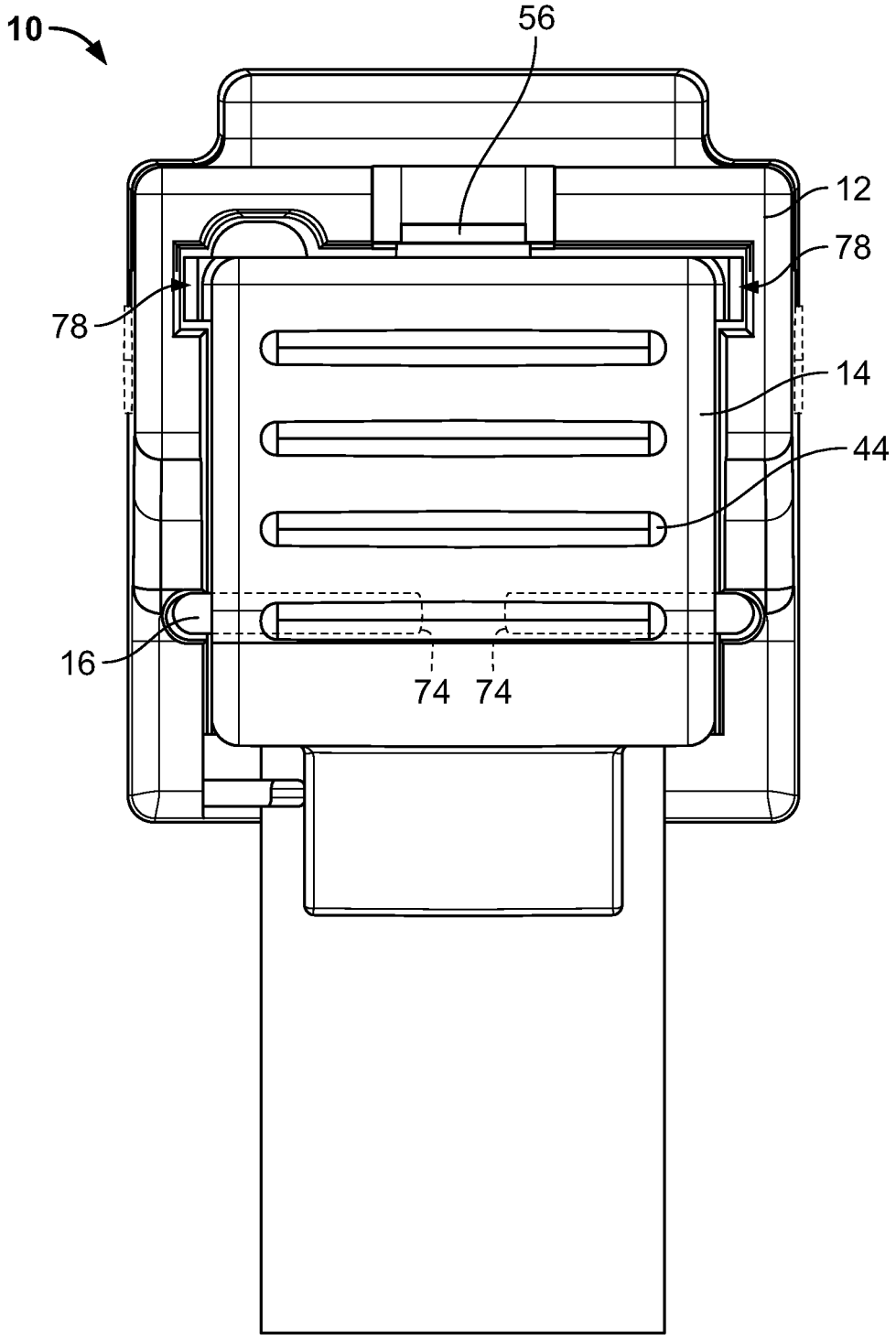
FIG. 7 is a right side view of the device in the closed position in which the clip arms, in phantom, are extended inward such that the arms of the clip can be received in opposing sides of the circuit breaker switch.

On the rear-facing side 66 of the body 14, there is a clip-receiving track 68 that is generally U-shaped and receives the clip 16 therein. The clip-receiving track 68 is recessed into the top and bottom side walls 70*a* and 70*b* and the rear wall 72 of the body 14 such that the clip 16, which is U-shaped having a pair of opposing terminal ends 74, is maintained in the clip-receiving track 68 and the terminal ends 74 are disposed proximate the recess 46. As will be described in greater detail below, the clip 16 may be pre-formed of a metallic material such that the terminal ends 74 may be biased away from one another in a rest state (best depicted in FIGS. 1, 2, and 3), but may be elastically moved toward one another under stress (for example, due to the movement of the housing 12 relative to the body 14 to cause the reversible deflection of the clip 16 as best depicted in FIG. 7).

As will be described in greater detail below, the clip 16 may serve as a biasing element or spring element for selectively causing the housing 12 and the body 14 to move apart from one another depending on their relative placement with respect to one another. However, there may also be other spring elements such as spring 18 which may be received in a leftward facing recess 76 in the body 14 to interpose the spring 18 between the housing 12 and the body 14.

Figure 5:
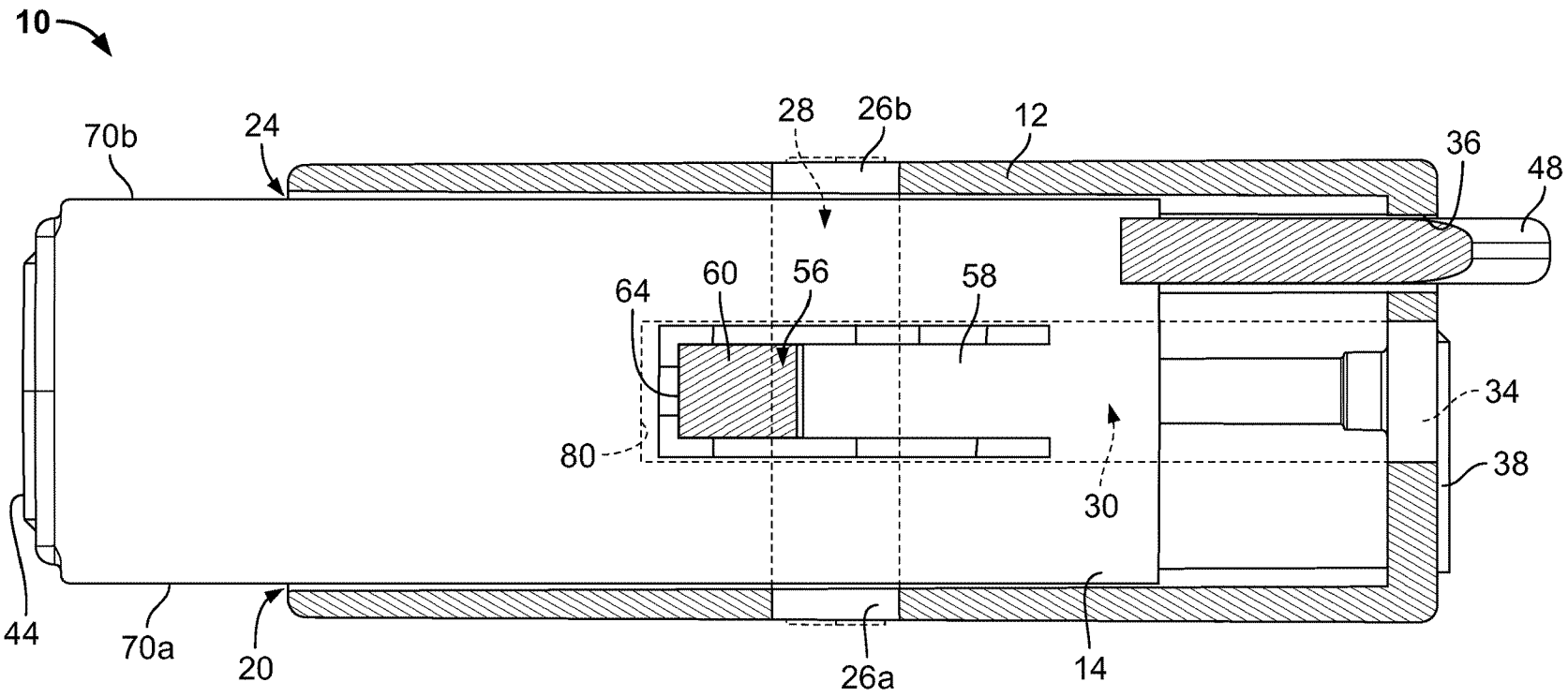
FIG. 5 is a front side cross-sectional view taken though line 5-5 of FIG. 1 illustrating the placement of the lock tab in the channel of the housing.

To assemble the lock out/tag out device 10, the clip 16 and/or spring 18 are received on the body 14 and the body 14 is slidably received into the central cavity 20 of the housing 12 along a guide track 78 comprising rails and guides between the housing 12 and the body 14 that delimits linear translation of the body 14 into the housing 12 as well as limits the direction of orientation during insertion. During assembly, the left side 42 of the body 14 is first inserted and moved towards the inside of the left side wall 22*e*, such that the tab 48 is received in the elongated slot 36. Moreover, the tang 56 is received into the channel 30 during the insertion after initially deflecting rearward in the region of the U-shaped cutout and then springing forward again once it is in the channel. It should be appreciated that there may be a locking ledge 80 (illustrated at the ends of the channel 30 in FIGS. 5 and 9) at the rightmost end of the channel 30 which can engage with the locking surface 64 to retain the body 14 within the housing 12 and to prevent the body 14 from being completely withdrawn from the housing 12 (unless the projection 60 is deflected via manual engagement with an instrument inserted through the opening 32 on the left side wall 22*e*). Because the channel 30 extends transversely with respect to the tie-receiving passageway 28, this means that, when a tie is not received in the passageway 28, the tang 56 and any associated projection 60 may freely move past the passageway 28 in either direction (although in some instances this may be against a biasing force of the clip 16 and/or spring 18).

In the assembled state, the clip 16 and/or spring 18 may generally bias the lock out/tag out device 10 toward the opened state by causing the body 14 to extend from the housing 12 to a limited extent dictated by engagement of the locking ledge 80 to the locking surface 64. However, even with this biasing force in place and as mentioned above, the interaction of the tang 56 of body 14 with the locking ledge on the housing 12 may prevent the body 14 from fully exiting the housing.

Now with additional reference to FIGS. 3-7, the general operation of the lock out/tag out device 10 will be described. In FIGS. 1 and 2 through 5, the lock out/tag out device 10 is illustrated in a generally opened position. In FIGS. 6 through 9, the lock out/tag out device 10 is illustrated in the closed position.

Figure 3:
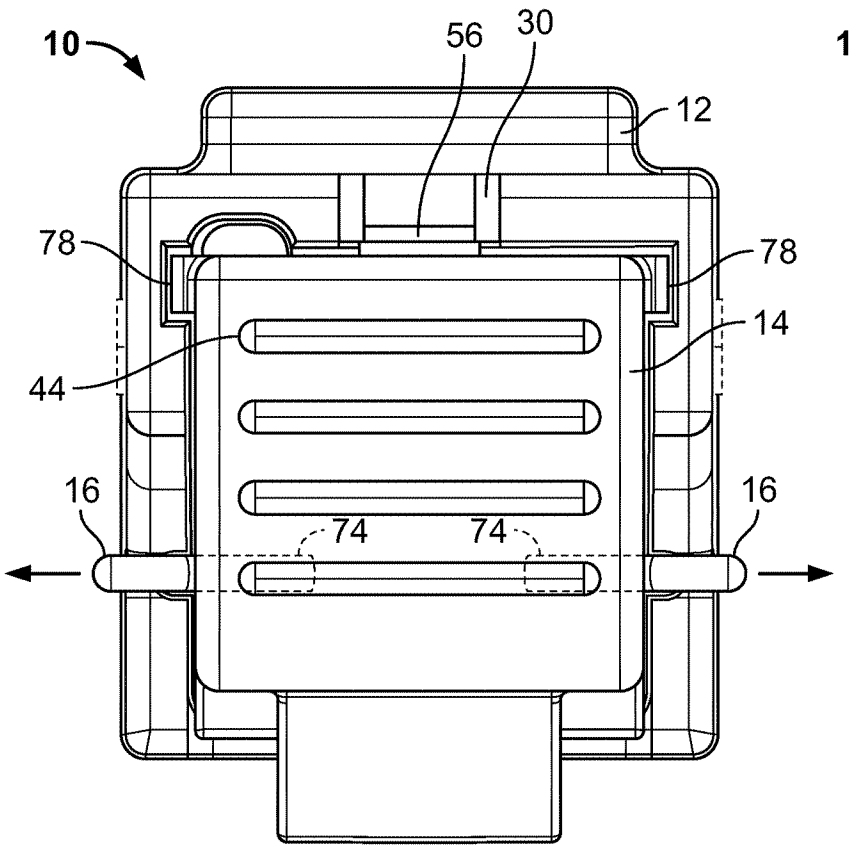
FIG. 3 is a right side view of the device of FIG. 1 with the arrows indicating the outward flexure of the arms of the clip (partially in phantom) toward the opened position in which the clip arms are biased outward to form a space therebetween.

When not in use, the lock out/tag out device 10 may be generally biased toward the opened position, which in this exemplary embodiment is the state in which the body 14 is extended at least partially rightward relative to the housing 12 in which the body 14 is received. This biasing to the opened position can be promoted by the outward engagement of the arms of the clip 16 proximate the terminal ends 74 separating from one another in the space between the body 14 and the housing 12. Accordingly and as best illustrated in FIG. 3, the terminal ends 74 of the clip 16 are spaced apart some initial distance in the switch-receiving recess 46 to fit onto and into a control switch 82 tongue.

Figure 6:
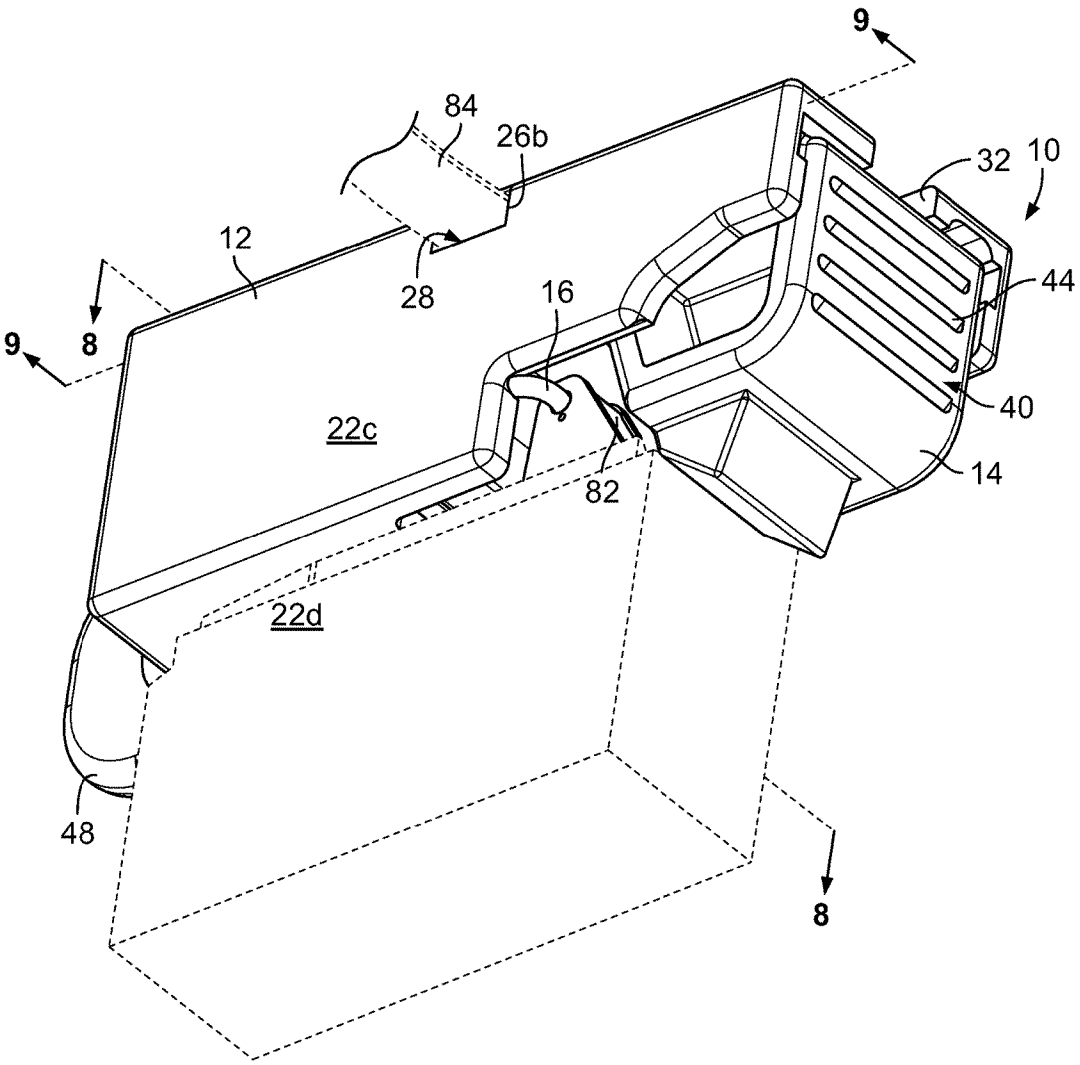
FIG. 6 is a perspective view of the device of FIG. 1 in the closed position with a tie, drawn in phantom, extending through the tie-receiving passageway in which the device is received on a circuit breaker switch, also drawn in phantom, to lock the switch in place.

In order to use the lock out/tag out device 10 to lock out or tag out a circuit breaker switch 82, as is illustrated in FIG. 6 best, the lock out/tag out device 10 is received over the control switch 82 and the lock out/tag out device 10 is moved to the closed position illustrated in FIGS. 6 through 9 by pressing the body 14 into the housing 12 (for example, by pinching the right and left ends together at the surfaces having the tactile projections 38 and 44). Among other things, when the body 14 is displaced into the housing 12, the terminal ends 74 of the clip 16 are moved together (as best depicted in FIG. 7) such that these terminal ends 74 can enter a set of opposing openings on the top and bottom side surfaces of the switch being isolated.

Figure 9:
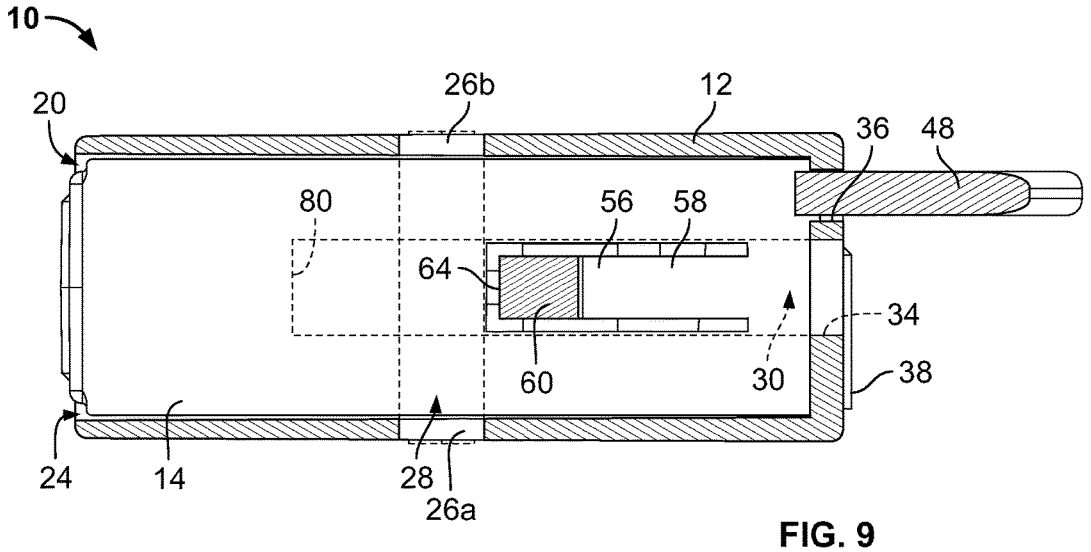
FIG. 9 is a front side cross-sectional view taken though line 9-9 of FIG. 6 illustrating the placement of the lock tab in the channel of the housing in the closed position with the tie in the tie-receiving passageway.

To maintain the lock out/tag out device 10 in the closed position, a tie 84, such as zip tie, is received through the openings 26*a* and 26*b* such that the tie 84 is disposed across the passageway 28. As best depicted in FIG. 9, when the lock out/tag out device 10 is in the closed position, the tang 56 is positioned such that, if the tie 84 fills the passageway 28, then the body 12 cannot be readily shifted back to a position in which the lock out/tag out device 10 is in the opened position because the locking surface 64 engages the tie 84 in the passageway 28 to prevent the shift back to the opened position.

It may also be the case that the tie 84 is preloaded in place with the lock out/tag out device 10 still open, even though a movement from the opened position to the closed position of the lock out/tag out device 10 is described in which the tie 84 is received in the passageway 28 after the lock out/tag out device 10 is closed. Then, when the lock out/tag out device 10 is moved from the opened position to the closed position, the inclined tapered surface 62 of the projection 60 of the tang 56 may engage the tie 84 to cause the tang 56 to temporarily deflect rearward until the projection 60 of the tang 56 has passed the tie 84 in a one-way manner. At this point, the tang 56 deflects forward and the locking surface 64 of the projection 60 now engages the tie 84 to prevent the movement of the housing 14 back toward the opened position.

It is further noted that, in the closed position, the opening 50 and slots 52*a* and 52*b* are accessible on the exterior of the lock out/tag out device 10. To further or alternatively restrict movement of the exemplary lock out/tag out device 10, a locking mechanism or item (for example, a padlock or secure cable) may be received in the opening 50 and/or slots 52*a* and 52*b* with the tab 48 in the extended position in the closed state of the lock out/tag out device 10. The placement of the locking mechanism or item in the opening 50 and/or slots 52*a* and 52*b* can prevent, either alone or in combination with the tie 84, the movement of the lock out/tag out device 10 back into the opened position.

It is contemplated that in some forms of use, the tie 84 may initially be in place within the passageway 28 such that the lock out/tag out device 10 can be initially attached by the end user one-handed. This tie 84 holds the lock out/tag out device 10 in the closed state over the control switch 82, which the hands of the user are freed up to apply the more heavy-duty locking mechanism on the tab 48. This may be the usage case in scenarios in which the lock out protocol would prevent the tie from being used alone to restrict access to a device.

It should also be appreciated that the orientation of the tab 48 relative to the control switch 82 and fixture in which that control switch 82 may be received may offer an improved ease of use since the direction of insertion is parallel and spaced from the wall/fixture in which the control switch 82 is likely received. Thus, the end user can avoid trying to thread a locking mechanism between the fixture and the lock out/tag out device 10 where there may be little space for maneuvering.

After the isolation of the control switch 82 and any associated work is complete, in order to then remove the lock out/tag out device 10 from the control, the tie 84 may be removed from the passageway 28 (potentially after cutting the tie 84) and any locking items or mechanisms in the tab 48 are removed. At this point, the lock out/tag out device 10 is again able to move back to the opened position as the body 14 is not restricted by the presence of a tie 84 or any other locking mechanisms in the tab 48. Moving the lock out/tag out device 10 back into the opened state causes the terminal ends 74 of the clip 16 to be withdrawn from the control switch 82 and the lock out/tag out device 10 may be altogether removed from the control switch 82.

It should be appreciated that, while the particular illustrated design from FIGS. 1 through 9 includes four components, the benefits associated with the tie-receiving passageway and tang structure may be achieved with fewer components. Indeed, and without limitation, as long as the device has a first portion and a second portion which are movable relative to one another, a tie-receiving passageway on the first portion of the device (above, the housing 12), and a tang on a second portion (above, the body 14) that may be transversely moved across the passageway relative to the direction of passageway extension, then the same functionality may be achieved. Thus, while the first embodiment provides much detailed structure, the principles of operation of using a tie-receiving passageway and a tang to temporarily restrict inter-component movement of a device for lock out/tag out usage may be more generally applied.

Figure 10:
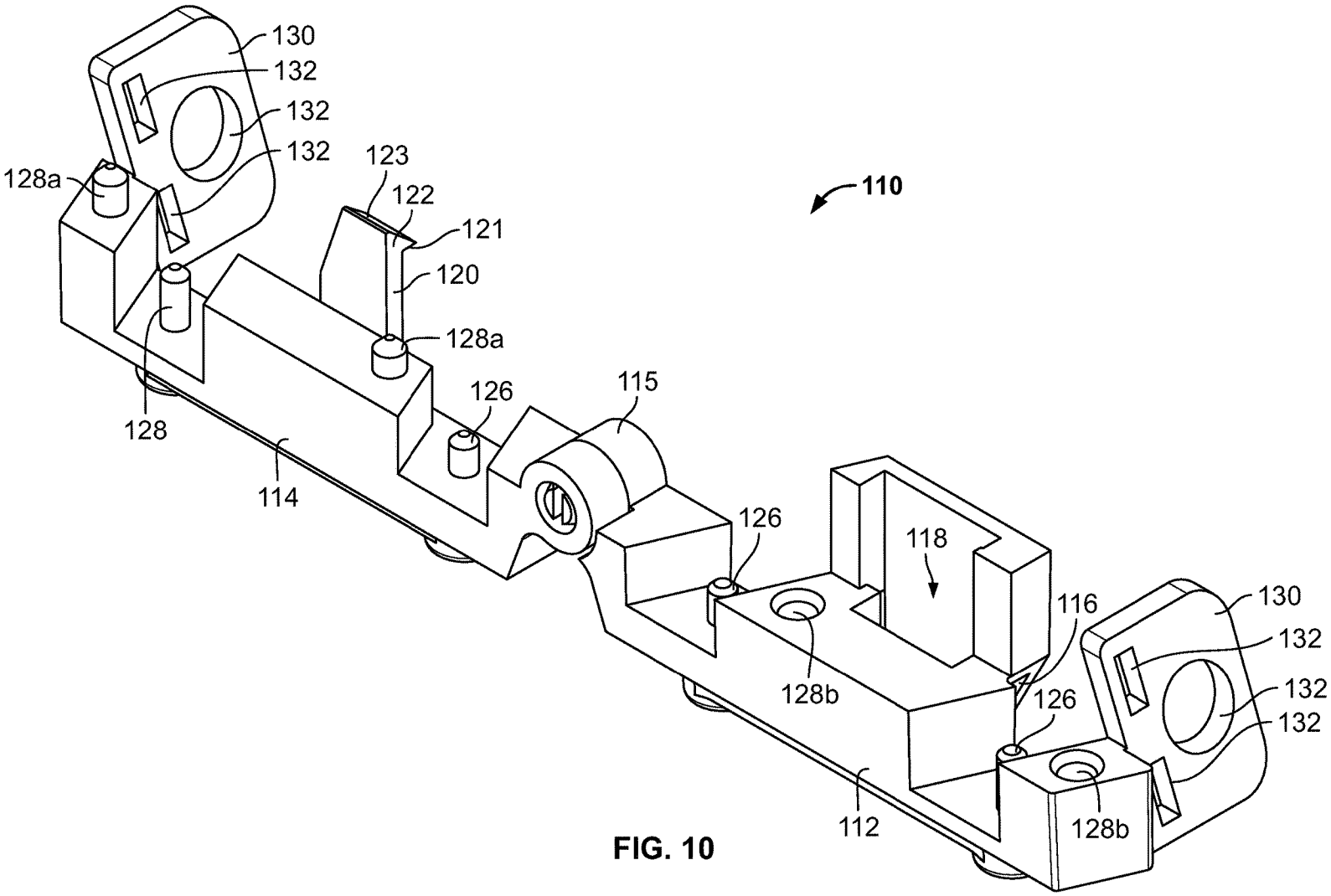
FIG. 10 is a perspective view of an alternative style of lock out/tag out device having a hinged joint in an opened position.
Figure 11:
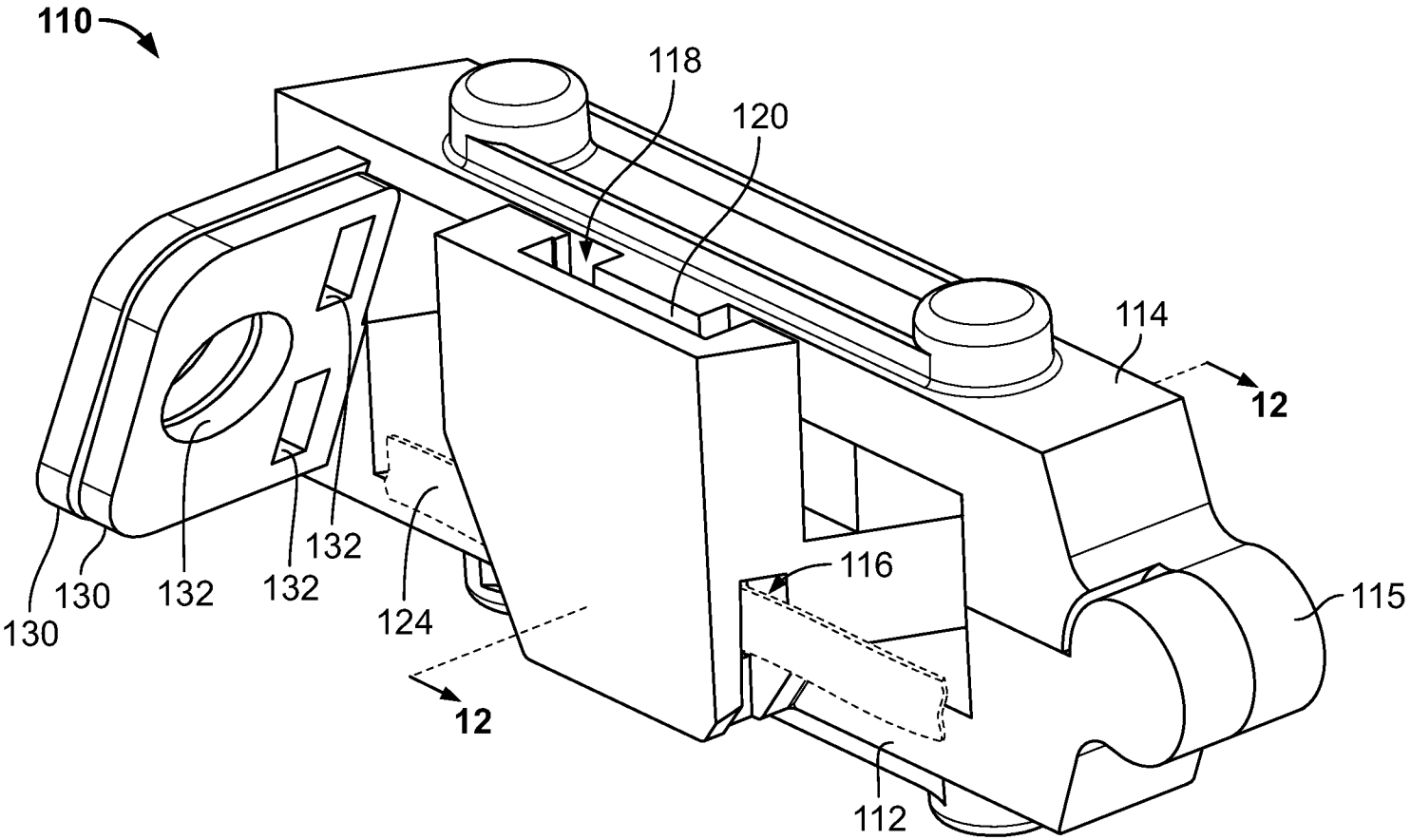
FIG. 11 is a perspective view of the device of FIG. 10 in the closed position with a tie, in phantom, extending through the tie-receiving passageway.
Figure 12:
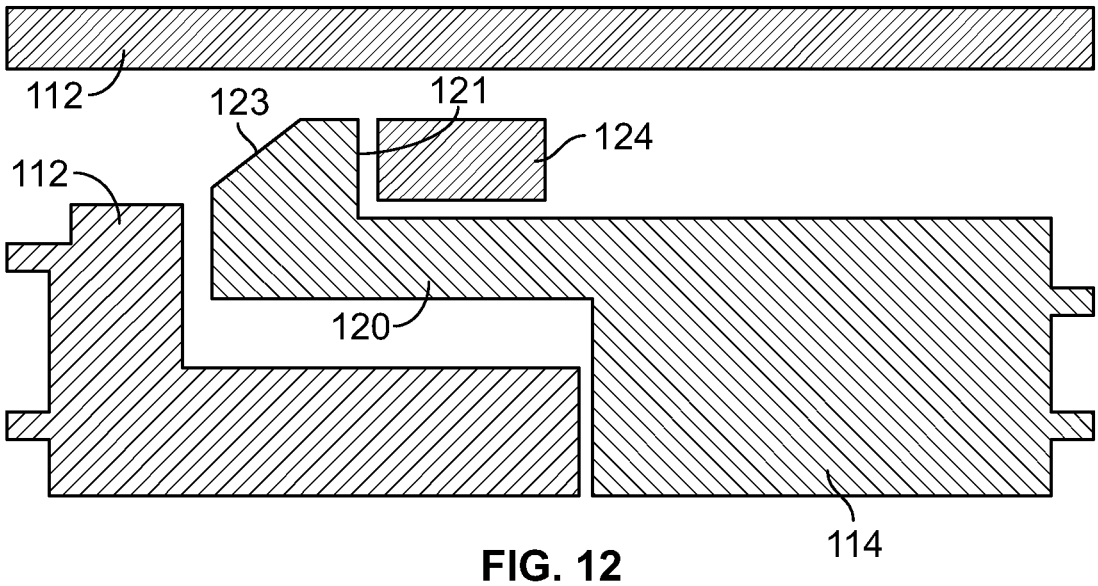
FIG. 12 is a cross-sectional view taken through line 12-12 of FIG. 11 illustrating the area of the passageway, tang, and tie that locks the movement of the portions relative to one another while the tie is in place.

To provide another exemplary embodiment of a device that employs this construction, a lock out/tag out device 110 for limiting the use of a control switch is illustrated in FIGS. 10 and 11 in opened and closed states, respectively with a further FIG. 12 illustrating the detail of the locking arrangement in the closed state. This lock out/tag out device 110 is now briefly described to illustrate how the principles described herein might, in a non-limiting way, be applied to devices of other constructions.

In brief, the lock out/tag out device 110 includes a first portion 112 and a second portion 114 having a hinged connection at a joint 115. In the illustrated embodiment, the first portion 112 and the second portion 114 maybe separate bodies that are connected at a mechanical joint in which one of the portions is rotatable relative to the other at a fastened connection point. However, it is contemplated that in other forms, the illustrated joint might be replaced with a living hinge, such that the first portion and second portion are integrally molded with one another.

As with the first embodiment, the first portion 112 has a tie-receiving passageway 116 as well as a transversely-extending channel 118 and the second portion 114 has a tang 120 with a projection 122.

When the first portion 112 is rotated relative to the second portion, the tang 120 is rotatably received in the channel 118 to transversely cross over the tie-receiving passageway 116. Just as before, a tie 124 (illustrated in phantom in FIG. 11) can be received in this passageway 116 either before or after movement of the portions 112 and 114 relative to one another to prevent the lock out/tag out device 110 from being moved from the closed position in FIG. 11 back to the opened position in FIG. 10 by virtue of the locking surface 121 engaging the tie 124 received in the passageway 116. In the instance in which the tie 124 is in the passageway 116 prior to closing the lock out/tag out device 110, the inclined tapered surface 123 of the tang 120 can engage the tie 124 to temporarily deflect the tang 120 during closing the lock out/tag out device 110 before the tang 120 snaps back into place such that the locking surface 121 prevents movement of the tang 120 back past the tie 124 (i.e., prevents the re-opening of the lock out/tag out device 100). Only once the tie 124 is removed, the lock out/tag out device 110 can be moved back to the opened state.

While it is not critical to an understanding of the functioning of the tie-restricting structure of the lock out/tag out device 110, other features are present in the device 110 which merit brief description. Among other things, the rotating halves or portions 112 and 114 each include posts 126 for interaction with control switch elements, mating features 128*a* and 128*b* for effectuating seating of the portions 112 and 114 together, and a pair of mating plates 130 which provide lock out/tag out openings 132 that may be used in conjunction with the tie-restricting structure to prevent portions 112 and 114 from movement apart.

It should be appreciated that while two exemplary embodiments are disclosed, these illustrated embodiments are in no way limiting. The tie-restricting structure described herein may be employed in various other lock out/tag out structures in which one portion of the device moves relative to another portion of the device with reverse movement prevented by the presence of a tie body. Among other things, this provides improved ease of application of the device to an energy control component making it easier to apply the device with a single hand initially. The tie-restraining structure described herein enables the user to install a workman's protective tag to the lock out/tag out device using a non-reusable tie "before" the lock out/tag out device is applied to an energy isolation control device. Once the lock out/tag out device is applied to the energy isolation control device to prevent its movement back to on, the non-reusable tie prevents the lock out/tag out device movable portions from movements and therefore prevents the lock out/tag out device from removal until the removable tie is cut and removed.

It should be appreciated that various other modifications and variations to the preferred embodiments can be made within the spirit and scope of the invention. Therefore, the invention should not be limited to the described embodiments. To ascertain the full scope of the invention, the following claims should be referenced.

What is claimed is:

1. A device for temporarily restricting use of a control via at least one of lock out and tag out, the device comprising:

a first portion having a passageway extending therethrough along a distance of passageway extension, the passageway being adapted for reception of a tie;

a second portion having a tang comprising an arm extending to a distal end having a projection, the arm being elastically flexible relative to a remainder of the second portion to accommodate a temporary deflection of the projection of the tang, the second portion being movable relative to the first portion to move the tang transversely across the passageway relative to the direction of passageway extension thereby toggling the device between an opened position in which the projection of the tang is on one side of the passageway and a closed position in which the projection of the tang is on the other side of the passageway; and wherein a tie is receivable in the passageway and a reception of the tie in the passageway prevents the device from being moved from the closed position back into the opened position due to inability of the tang of the second portion to be moved past the tie in the passageway of the first portion.

2. The device of claim 1, wherein the projection has an inclined tapered surface with respect to a direction of movement of the second portion relative to the first portion and a locking surface that is perpendicular to the direction of movement of the second portion relative to the first portion.

3. The device of claim 1, wherein the first portion is a housing with an internal cavity and the second portion is a body received at least in part within the housing and wherein the body is linearly translatable within the housing to toggle the device between an opened position and a closed position.

4. The device of claim 3, further comprising a clip received between the housing and the body in which the clip is U-shaped having a pair of terminal ends that face one another.

5. The device of claim 4, wherein the clip has a predefined unstressed shape and is elastically deformable under stress to alter a spacing distance between the pair of terminal ends and wherein, when the device is in the opened position, the ends have an opened spacing distance and, when the device is in the closed position, the ends have a closed spacing distance and wherein the opened spacing distance is greater than the closed spacing distance.

6. The device of claim 3, wherein the body includes a tab with at least one opening formed in the tab and the housing has a slot through which the tab extends; wherein, in the closed position, the at least one opening is outside the housing; and wherein a presence of an item through the at least one opening in the closed position prevents the body from being translated relative to the housing, as the item in the at least one opening would interfere with the housing, such that the device cannot be moved from the closed position to the opened position when the item is in the at least one opening.

7. The device of claim 6, wherein the at least one opening in the tab extends in a direction parallel with the direction of passageway extension.

8. The device of claim 1, wherein the first portion and the second portion are pivotable relative to one another about an axis of rotation, and wherein, when the device is toggled between the opened position and the closed position, the tang of the second portion rotates transversely across the passageway of the first portion.

9. The device of claim 1, wherein the passageway is an open channel with at least one unbounded side over at least some portion of the distance of passageway extension.

10. The device of claim 1, wherein the passageway is a closed channel having openings only the ends of the distance of passageway extension.

* * * * *